US005312493A

United States Patent [19]

Masui et al.

[11] Patent Number: 5,312,493

[45] Date of Patent: May 17, 1994

[54] LOW-YIELD-RATIO HIGH-STRENGTH HOT-ROLLED STEEL SHEET AND METHOD OF MANUFACTURING THE SAME

[75] Inventors: Susumu Masui; Masahiko Morita; Toshiyuki Kato, all of Chiba, Japan

[73] Assignee: Kawasaki Steel Corporation, Japan

[21] Appl. No.: 996,130

[22] Filed: Dec. 23, 1992

[30] Foreign Application Priority Data

Dec. 27, 1991 [JP] Japan ..... 3-358007

[51] Int. Cl.[5] ..... C22C 38/02; C21D 8/00

[52] U.S. Cl. ..... 148/326; 148/602; 148/654

[58] Field of Search ..... 148/326, 602, 654

[56] References Cited

FOREIGN PATENT DOCUMENTS 2282419 11/1990 Japan ..... 148/602

*Primary Examiner*—Deborah Yee

*Attorney, Agent, or Firm*—Austin R. Miller

[57] ABSTRACT

A low-yield-ratio high-strength hot-rolled steel sheet having the advantageous features of both conventional precipitation-strengthened steel and structure-strengthened steel and free from the drawbacks of these conventional steels, and a manufacturing method characterized in hot-rolling such a steel sheet. The steel sheet has an upper limit of C content of about 0.18 wt. %, and the lower C content limit approximately satisfies $C \geqq 0.05 + Ti/4 + Nb/8$ in relationship with the content of Ti and/or Nb. The steel sheet also contains about 0.5 to 2.5 wt. % Si and has a structure essentially formed of ferrite in which a carbide of Ti and/or Nb is precipitated, martensite and retained austenite.

3 Claims, 4 Drawing Sheets

FIG. 2
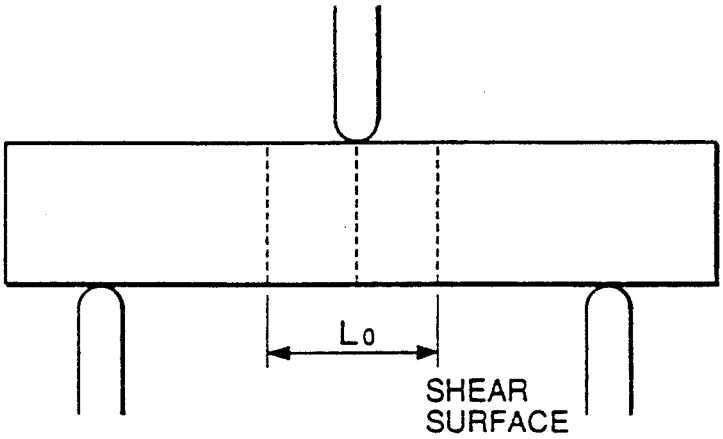
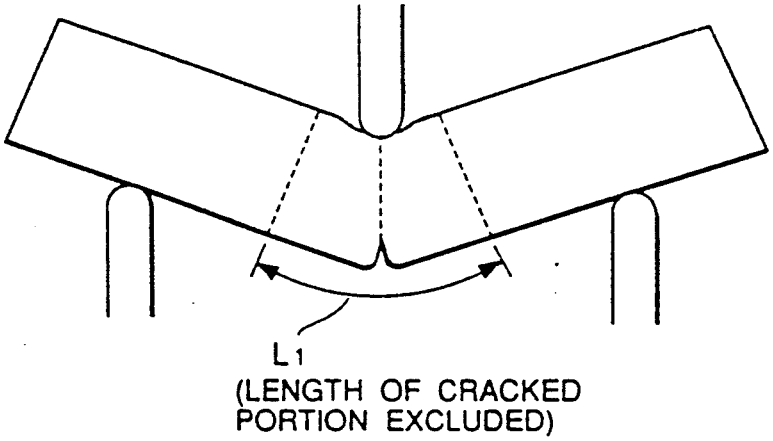
FIG. 2a

LOW-YIELD-RATIO HIGH-STRENGTH HOT-ROLLED STEEL SHEET AND METHOD OF MANUFACTURING THE SAME

BACKGROUND OF THE INVENTION

1. Field of the Invention

This invention relates to a high-strength hot-rolled steel sheet having special advantage for use as inner plates, chassis parts and strength members of motor vehicles, and having a tensile strength of 70 to 100 kgf/mm$^2$, and further relates to a novel method of manufacturing the steel sheet.

2. Description of the Related Art

Conventionally, high strength steel sheets have widely been used to form inner plates, chassis parts and strength members of motor vehicles in order to reduce the weight of the vehicle body. High strength is required for safety's sake; other properties, e.g., good formability or workability under working, typically, pressing, and good fatigue resistance characteristics after working are also required.

Cold-rolled steel sheets have often been used as steel sheets satisfying these conditions. However, to reduce manufacturing cost, hot-rolled steel sheets have frequently been adopted in recent years.

Further strength improvement of hot-rolled steel sheets is required to enable further reduction of vehicle body weight because of recent strict motor vehicle regulations. Products in a tensile strength (TS) range of 70 to 100 kgf/mm$^2$ are now increasingly used over those in a TS range of 50 to 60 kgf/mm$^2$.

With respect to such high-strength hot-rolled steel sheets, typical important properties are:

(1) stable high strength with only small variations of quality and consistency,
(2) low yield ratio,
(3) ease of production requiring no severe hot-rolling conditions,
(4) improved spot welding workability,
(5) improved fatigue properties, and
(6) improved rolled shape.

Many different methods are available for strengthening conventional hot-rolled steel sheets having a tensile strength of 50 to 60 kgf/mm$^2$. Known examples include solid-solution strengthening, structure strengthening, precipitation strengthening and grain refining strengthening. Such strengthening methods are used to manufacture various items to obtain optimum quality and economical features for each item.

For strengthening hot-rolled steel sheets having a tensile strength in the range of about 70 to 100 kgf/mm$^2$, however, available strengthening means are very limited. It is a problem that high strength cannot be achieved by treatment that is mainly based on solid-solution strengthening or grain refining strengthening. Even by precipitation strengthening enabling improved weldability and stable manufacturing, it is difficult to achieve a tensile strength higher than 80 kgf/mm$^2$. In fact, substantially no practical manufacturing means is available, other than structure strengthening with pearlite or bainite, or precipitation strengthening.

Precipitation-strengthened high strength steel has a high yield ratio (ordinarily 0.80 or higher). In particular, with respect to steel having a tensile strength of 80 kgf/mm$^2$ or larger, the yield ratio is so high that the spring-back of the steel after pressing is excessive for many purposes.

On the other hand, structure-strengthened steel is advantageous in that it entails no considerable incompatibility between strength increase yield reduction. For example, a ferrite-martensite dual phase mixture steel called dual phase steel and disclosed in Japanese Patent Publication Sho 61-15128 has highly improved elongation characteristics and fatigue resistance characteristics. Also with respect to this structure-strengthened steel, if a TS of 80 kgf/mm$^2$ or larger is required, strict manufacturing conditions must be followed; otherwise, serious shape defects or variations of quality occur in the manufacturing process.

Japanese Patent Laid-Open Hei 1-312032 also discloses a dual phase steel having a ferrite-martensite mixture structure. However, the TS of this steel is very low, such as 50 to 72 kgf/mm$^2$.

An $(\alpha+\gamma)$ structure steel having a tensile strength of 80 to 100 kgf/mm$^2$, called TRIP steel, is also disclosed in Japanese Patent Laid-Open Hei 3-10049. This TRIP steel is a high-strength steel and achieves its characteristic properties by particularly weighting the workability factor. In the case of this TRIP steel, however, the tensile strength is greatly influenced by phase percentages in the steel, in particular, the amount of retained austenite. For this reason it is very difficult to produce the steel with uniform quality. This is particularly true with respect to quality uniformity along the widthwise and lengthwise directions of the steel band. Moreover, the carbon content of this steel is so high that its spot welding weldability inevitably deteriorates.

For the foregoing and other reasons, there is no steel presently available which satisfies the important requirements for a desirable low-yield-ratio high-strength hot-rolled steel sheet.

SUMMARY OF THE INVENTION

It is accordingly an object of the present invention to provide a low-yield-ratio high-strength hot-rolled steel sheet having the advantageous features of conventional precipitation-strengthened steel and structure-strengthened steel and improved by advantageously solving the problems of the known art, and to provide a new method for manufacturing this steel sheet.

We have found, as a result of many experiments and studies, that the foregoing problems can be solved by the process of this invention. A conventional precipitation-strengthened steel is provided as a base, a controlled carbon content is established by considering the carbon relationship with Ti and Nb, a controlled content of Si is added, and hot rolling is performed under special conditions. Precipitation strengthening is thereby effected simultaneously with $\gamma$ to $\alpha$ transformation after rolling, and carbon discharged from ferrite grains is concentrated in untransformed austenite grains. A composite structure is finally formed which is mainly formed of a precipitation-strengthened ferrite phase, and which contains a small proportion of a martensite phase or a retained austenite phase as a secondary phase.

The steel in accordance with the present invention is improved in strength by precipitation-strengthening a soft ferrite phase. This is sharply different from conventional dual phase steel or TRIP steel. On the other hand, the content of the proportion of martensite or the proportion of the retained austenite phase required to obtain the same strength is thereby reduced in comparison with the conventional method, whereby the increase in the equivalence of carbon is thereby limited.

In comparison with conventional precipitation-strengthened steel, the steel in accordance with the present invention has a sharply higher strength by virtue of the existence of the hard secondary phase, and also exhibits a low yield ratio characteristic because a high-density dislocation network tends to be formed around the secondary phase. Moreover, a certain conformity is maintained between the secondary phase and the ferrite grains, which improves the strength-ductility balance. Also, because the secondary phase stops the propagation of fatigue cracks, the fatigue resistance characteristics of the steel are significantly improved. Further, the difference between the strengths of the ferrite grains and the secondary phase is smaller than that in conventional dual phase steel. The concentration of local deformations of the ferrite grains is therefore limited, so that local deformability, which is disadvantageously low in conventional strengthened steels of this kind, can be improved.

This invention is accordingly directed to low-yield-ratio high-strength hot-rolled steel sheet having a composition consisting essentially of about 0.18 wt. % or less of C, about 0.5 to 2.5 wt. % of Si, about 0.5 to 2.5 wt. % of Mn, about 0.05 wt. % or less of P, about 0.02 wt. % or less of S, about 0.01 to 0.1 wt. % of Al, at least one of about 0.02 to 0.5 wt. % of Ti and about 0.03 to 1.0 wt. % of Nb, Ti and Nb, the balance being substantially Fe and incidental impurities.

The structure of the steel is formed of ferrite in which a carbide of Ti and/or Nb is precipitated and martensite, or of ferrite in which this carbide is precipitated, martensite and retained austenite. The following formula controls the approximate relative amounts of C, Ti and Nb:

$$C \text{ wt. } \% \geqq 0.05 + Ti \text{ wt. } \%/4 + Nb \text{ wt. } \%/8.$$

The present invention also provides a low-yield-ratio high-strength hot-rolled steel sheet having a composition formed by adding about 0.3 to 1.5 wt. % of Cr to the above-described composition.

The present invention further provides a method of manufacturing a low-yield-ratio high-strength hot-rolled steel sheet having a structure formed of ferrite, which is precipitation-strengthened, and martensite, or of precipitation-strengthened ferrite, martensite and retained austenite. The method comprises providing a steel slab of the above-described composition as a raw material, hot rolling the steel slab, finishing rolling at a temperature of about 820° C. or higher, retaining the steel sheet in the range of temperatures of about 820° to 720° C. for 10 seconds or longer, cooling the steel sheet at a cooling rate of about 10° C./sec or higher, and coiling temperature of about 500° C. or lower.

BRIEF DESCRIPTION OF THE DRAWINGS

FIGS. 2 and 2*a* are schematic illustrations of a side bending test method;

DESCRIPTION OF THE PREFERRED EMBODIMENT

We have conducted test work which is well described by the following illustrative example. The example is, of course, not intended to limit the scope of the invention.

Steel used in this test work was prepared by adding Si in the range of 0.15 to 3.00 wt. % to a conventional precipitation-strengthened steel having a composition of 0.07 wt. % of C, 1.50 wt. % of Mn, 0.01 wt. % of P, 0.001 wt. % of S, 0.04 wt. % of Al and 0.05 wt. % of Nb. We have discovered that the use of Si greatly influenced the precipitation reaction of NbC in ferrite grains and the concentration of C into untransformed austenite phases. Although the reasons for this phenomenon are not conclusively established, we believe this is because Si acts to change the $Ar_3$ transformation point of the material and acts to increase the $(\gamma+\alpha)$ dual phase region and thereby promotes two-phase separation at the time of the $\gamma$ to $\alpha$ transformation.

Figure 1:
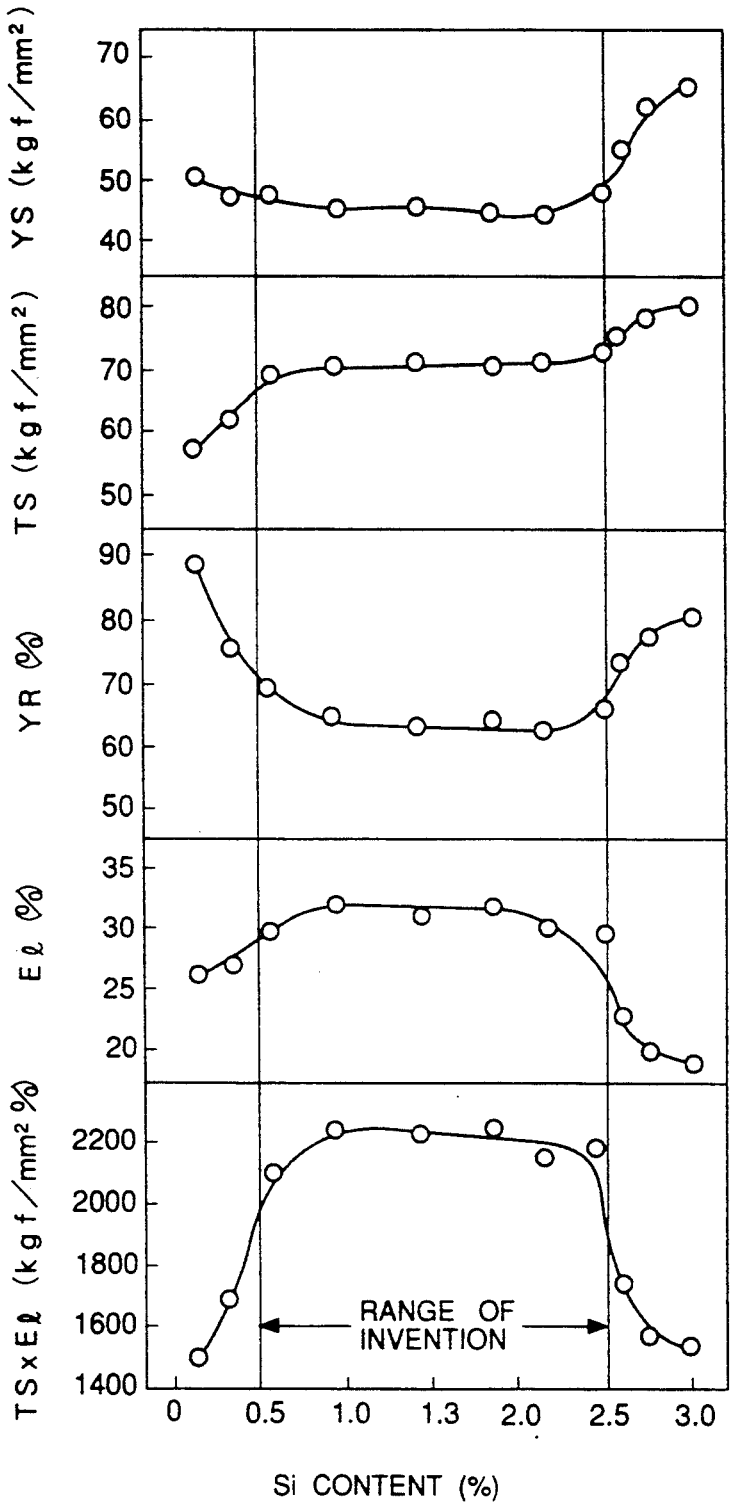
FIG. 1 is a graph showing relationships between tensile characteristic values and the content of Si.

In any event the above-described steel slab was hot rolled under conditions conforming generally to those of the present invention (setting the same slab size and the same finished size) to manufacture a hot-rolled steel sheet having a thickness of 2.00 mm, and the tensile characteristics of this steel sheet were tested. FIG. 1 shows relationships between tensile characteristic values (YS, TS, YR, El, TS×El) and the content of Si on the basis of this test work.

As is apparent from FIG. 1, a low YR-high El characteristic is exhibited and a remarkably good strength-ductility balance is achieved throughout a Si content range of about 0.5 to 2.5 wt. %. This confirmed the beneficial effects of controlled Si concentrations, in particular, that of promoting two-phase separation at the time of the $\gamma$ to $\alpha$ transformation.

The reason for limiting the component content ranges in the steel of the present invention as described above with will now be described.

If the content of C is greater than about 0.18 wt. %, spot-welding weldability is considerably reduced. Therefore, the upper limit of the C content is basically limited to about 0.18 wt. % or less. However, if the C content does not satisfy the approximate condition: $C \geqq (0.05+Ti/4+Nb/8)$wt. % in its relationship with Ti and Nb, C is consumed with priority for the precipitation reaction of TiC and NbC at the time of the $\gamma$ to $\alpha$ transformation so that the extent of C concentration into untransformed $\gamma$ grains becomes insufficient. The stability of the untransformed $\gamma$ grains as austenite is thereby reduced, and the secondary phase becomes difficult to change into martensite or retained austenite, resulting in failure to achieve a good strength-ductility balance and a low YR characteristic.

Thus, it is necessary to select the lower limit of the approximate C content range to satisfy the relationship: $C \text{ wt. } \% \geqq 0.05 + Ti \text{ wt. } \%/4 + Nb \text{ wt. } \%/8$. In the equation C, Ti and Nb represent the contents of C, Ti, and Nb, respectively and are values in percent by weight. The two parameters Ti/4 and Nb/8 correspond to stoichiometric amounts of C consumed when C combines with Ti and Nb to form TiC and NbC, respectively.

The present invention serves to form a martensite phase or a retained $\gamma$ phase upon precipitating TiC and NbC in the ferrite phase of the final structure. Accordingly, the right-hand members of the equation represent a value obtained by adding about 0.05 wt. % of C to the amount of C necessary for forming TiC and NbC. This approximate 0.05 wt. % amount of C is a lowermost limit of C necessary for forming a low-temperature transformed phase of a predetermined proportion in accordance with the above-described objective of the present invention. The microstructure achieved by the present invention cannot be created unless the content of C added to the steel is in the approximate range of values equal to or higher than the value represented by the right-hand members of the equation.

Si is a most important element in accordance with the present invention. It acts to promote the precipitation of TiC and NbC into ferrite at the time of the $\gamma$ to $\alpha$ transformation and also to form martensite and retained austenite as a secondary phase. As described above, the effect of addition of Si is exhibited when the content of added Si is about 0.5 wt. % or more. If the content of Si exceeds about 2.5 wt. % the effect is saturated and, on the other hand, the descaling effect after hot rolling is reduced and the manufacturing cost is increased. Therefore, the content of Si according to this invention is within the range of about 0.5 to 2.5 wt. %.

If the content of Mn is less than about 0.5 wt. %, the desired composite structure cannot be obtained. On the other hand, if the content of Mn exceeds about 2.5 wt. %, the $Ar_3$ transformation point is excessively reduced so that $\alpha$ grains hardly precipitate during cooling after hot rolling. The likelihood of TiC and MnC precipitation is thereby reduced and TiC and MnC remain in a supersaturated condition making it difficult to achieve precipitation strengthening. Therefore, the content of Mn is within the range of about 0.5 to 2.5 wt. %.

The content of P is limited to about 0.05 wt. % or less in order to ensure the desired formability and weldability.

The content of S is limited to about 0.02 wt. % or less to limit the reaction with Mn in the steel forming sulfide of manganese inclusions which deteriorate stretch flanging formability.

It is necessary to add at least about 0.010 wt. % of Al for deterging the steel. Increase of detergency is indispensable for strengthening the steel. However, addition of an amount of Al exceeding about 0.10 wt. % is not desirable because of possible formation of surface defects or the like caused by alumina clusters. Therefore, the content of Al is within the range of about 0.010 to 0.10 wt. %.

Ti and Nb are elements having important roles in accordance with the present invention. These elements precipitate in the form of carbides in $\alpha$ grains simultaneously with the $\gamma$ to $\alpha$ transformation after hot rolling to contribute greatly to base strengthening. However, if the contents of Ti and Nb are too small the precipitated grains are coarse and decrease the precipitation strengthening effect. Also, the proportion of the secondary phase is thereby increased so that the structure tends toward the structure-strengthened type. On the other hand, if the contents of Ti and Nb are too large the amount of C available for forming the secondary phase is insufficient, so that the resulting characteristics of the steel tend toward those of a precipitation-strengthened high strength steel.

For this reason, the content of Ti is preferably within the range of about 0.02 to 0.5 wt. % and the content of Nb is preferably within the range of about 0.03 to 1.0 wt. %. Since Ti and Nb have a common effect, they may be used selectively; at least one of them may be used in the above-described range.

In accordance with the present invention, a suitable amount of Cr may be added along with the above-described components. Cr serves as a substitute for Mn. A suitable range of content of added Cr is about 0.3 to 1.5 wt. %.

Suitable conditions used in manufacturing the steel according to the present invention will be described below.

First, with respect to hot rolling, the finishing rolling temperature is controlled to about 820° C. or higher. If the temperature is lower than about 820° C., deterioration of ductility after hot rolling is considerable.

As a hot rolling condition in accordance with the present invention, the steps of temporarily cooling a continuously cast slab, heating the slab again and roughly rolling the slab may be used, or the steps of roughly rolling a continuously cast slab immediately or after heat retaining without allowing a reduction of temperature to about 820° C. or lower, and thereafter roughly rolling the slab, may be used as an energy saving measure.

In accordance with the present invention it is necessary to retain the strip in a temperature range of about 820° to about 720° C. for about 10 seconds or longer after completion of hot rolling. If this retention time is shorter than about 10 seconds the extent of $\gamma$ to $\alpha$ transformation is insufficient. The extents of precipitation of TiC or NbC into transformed $\alpha$ grains and the concentration of C into untransformed $\gamma$ grains are insufficient, resulting in failure to obtain the desired composite structure formed of a precipitation-strengthened ferrite and martensite, or of precipitation-strengthened ferrite and martensite and retained austenite.

It is necessary to control the cooling rate from this retention to coiling to about 10° C./sec or higher. If this cooling rate is lower than about 10° C./sec, formation of pearlite takes place.

It is necessary to control the coiling temperature to about 500° C. or lower. If the coiling temperature is higher than about 500° C., formation of bainite takes place. The lower limit of this coiling temperature is not particularly critical and may be substantially any temperature so long as the desired shape, after coiling, can be maintained.

The following Examples are illustrative of the invention. They are not intended to define or to limit its scope, which is defined in the appended claims.

Examples

Fifteen steel slab compositions (A-O) were prepared as shown in Table 1. Nine types were in accordance with this invention, and six types were steels slabs provided as comparative examples. All of the steel slabs were hot-rolled under various conditions to manufacture hot-rolled steel sheets each having a thickness of 2.00 mm. Tensile characteristics, side bending elongations (in direction C), hole expanding ratios, fatigue strengths and structures of the hot-rolled steel sheets were examined. The compositions appear in Table 1 which follows.

TABLE 1

| Steel | C | Si | Mn | P | S | Al | O | N | Ti | Nb | Cr | 0.05 + Ti/4 + Nb/8 | Note |
|---|---|---|---|---|---|---|---|---|---|---|---|---|---|
| A | 0.069 | 1.47 | 1.77 | 0.007 | 0.0010 | 0.044 | 0.0017 | 0.0019 | 0.051 | — | — | 0.063 | Steel of the invention |
| B | 0.079 | 1.62 | 1.96 | 0.02 | 0.0009 | 0.047 | 0.0029 | 0.0024 | — | 0.2 | — | 0.075 | Steel of the invention |
| C | 0.093 | 1.53 | 1.78 | 0.01 | 0.0011 | 0.042 | 0.0025 | 0.0031 | 0.08 | 0.15 | — | 0.089 | Steel of the invention |
| D | 0.106 | 1.72 | 1.45 | 0.01 | 0.0008 | 0.048 | 0.0035 | 0.0029 | 0.2 | — | — | 0.100 | Steel of the invention |
| E | 0.130 | 1.39 | 1.51 | 0.02 | 0.0013 | 0.041 | 0.0030 | 0.0025 | — | 0.6 | — | 0.125 | Steel of the invention |
| F | 0.167 | 1.43 | 1.39 | 0.01 | 0.0010 | 0.046 | 0.0022 | 0.0033 | 0.25 | 0.4 | — | 0.163 | Steel of the invention |
| G | 0.080 | 1.95 | 0.95 | 0.01 | 0.0015 | 0.046 | 0.0036 | 0.0022 | — | 0.2 | 1.3 | 0.075 | Steel of the invention |
| H | 0.115 | 1.50 | 1.10 | 0.02 | 0.0010 | 0.039 | 0.0029 | 0.0027 | 0.2 | — | 0.9 | 0.100 | Steel of the invention |
| I | 0.150 | 1.15 | 1.35 | 0.01 | 0.0007 | 0.042 | 0.0026 | 0.0019 | 0.15 | 0.35 | 0.5 | 0.131 | Steel of the invention |
| J | 0.068 | 1.68 | 1.43 | 0.01 | 0.0014 | 0.045 | 0.0026 | 0.0035 | 0.04 | 0.1 | — | 0.073 | Comparative steel, C out of lower limit |
| K | 0.185 | 1.35 | 1.37 | 0.02 | 0.0009 | 0.048 | 0.0021 | 0.0026 | 0.2 | 0.5 | — | 0.163 | Comparative steel, C out of upper limit |
| L | 0.120 | 0.45 | 1.76 | 0.01 | 0.0017 | 0.041 | 0.0034 | 0.0019 | 0.15 | 0.2 | — | 0.113 | Comparative steel, Si out of lower limit |
| M | 0.085 | 2.61 | 1.23 | 0.02 | 0.0021 | 0.049 | 0.0025 | 0.0028 | 0.07 | 0.11 | — | 0.082 | Comparative steel, Si out of upper limit |
| N | 0.092 | 1.42 | 2.65 | 0.02 | 0.0007 | 0.046 | 0.0030 | 0.0024 | 0.12 | 0.08 | — | 0.090 | Comparative steel, Mn out of upper limit |
| O | 0.072 | 1.48 | 1.52 | 0.01 | 0.0013 | 0.044 | 0.0027 | 0.0031 | — | — | — | — | Comparative steel, No Ti, Nb added |

Tensile tests were made based on the conventional method using a JIS No. 5 test piece with respect to direction L.

With respect to the side bending elongation, test pieces having a length of 200 mm and widths of 40 mm were prepared. Each test piece was bent under conditions of the distance between supports: 150 mm, and the gage length: $L_0=50$ mm in accordance with the side bending test method schematically illustrated in FIG. 2 of the drawings. The gage length $L_1$ when a crack occurred was measured. The side bending elongation was calculated from the following equation:

$$\text{Side bending elongation } (\%)=(L_1-L_0)/L_0\times 100$$

Figure 3:
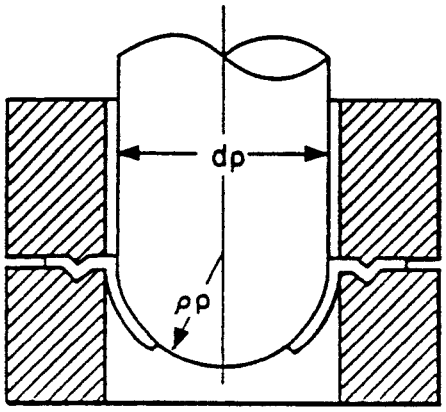
FIGS. 3 and 3*a* are schematic illustrations of an expanding test method.
Figure 3A:
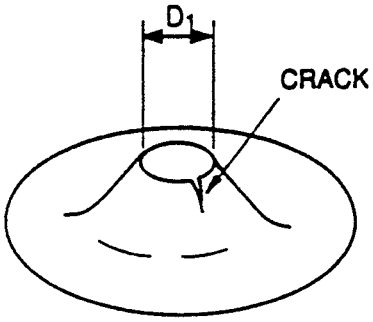

With respect to the hole expanding ratio, test pieces having a diameter of 150 mm were prepared. A central portion of each test piece around a hole formed by punching to provide a diameter of about 36 mm ($D_0$) was pressed with a spherical-head punch having a radius of 50 mm at its a lower end portion in accordance with a hole expanding ratio test method schematically illustrated in FIG. 3. The diameter $D_1$ when a very small crack occurred was measured. The hole expanding ratio was calculated from the following equation:

$$\text{Hole expanding ratio } (\%)=(D_1-D_0)/D_0\times 100$$

Figure 4:
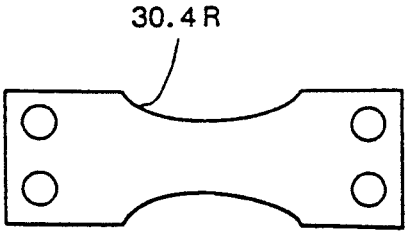
FIG. 4 is an illustration of the shape of a fatigue test piece.

The fatigue strength was obtained by a completely reversed plane bending fatigue test method using test pieces having a size shown in FIG. 4 (90 mm-15 mm-30.4R).

Table 2 shows both the hot rolling conditions and the results of these experiments.

TABLE 2

| No. | Steel | FDT (°C.) | Time for Retention (sec)* | Cooling Rate to Coiling (°C./s) | CT (°C.) | YS (kgf/mm²) | TS (kgf/mm²) | YR (%) | El (%) | TS × El (kgf/mm², /%) | Side Bending Elongation (%) | Hole Expanding Ratio (%) | Fatigue Strength | Note |
|---|---|---|---|---|---|---|---|---|---|---|---|---|---|---|
| 1 | A | 850 | 12 | 20 | 470 | 41 | 78 | 53 | 29 | 2262 | 27 | 40 | 37 | Ex. Inv. |
| 2 | A | 770 | 14 | 16 | 485 | 65 | 81 | 80 | 17 | 1377 | 23 | 31 | 29 | Comp. Ex. |
| 3 | B | 845 | 15 | 25 | 450 | 38 | 74 | 51 | 31 | 2294 | 28 | 42 | 36 | Ex. Inv. |
| 4 | B | 830 | 8 | 18 | 460 | 49 | 69 | 71 | 29 | 2001 | 30 | 49 | 27 | Comp. Ex. |
| 5 | C | 825 | 20 | 15 | 390 | 45 | 83 | 54 | 27 | 2241 | 26 | 39 | 39 | Ex. Inv. |
| 6 | C | 840 | 15 | 12 | 465 | 55 | 78 | 71 | 22 | 1716 | 27 | 39 | 30 | Comp. Ex. |
| 7 | D | 830 | 11 | 35 | 435 | 49 | 88 | 56 | 25 | 2200 | 24 | 33 | 42 | Ex. Inv. |
| 8 | D | 835 | 18 | 23 | 550 | 60 | 83 | 72 | 19 | 1577 | 25 | 35 | 32 | Comp. Ex. |
| 9 | E | 820 | 16 | 19 | 475 | 53 | 94 | 56 | 24 | 2256 | 22 | 30 | 44 | Ex. Inv. |
| 10 | E | 790 | 24 | 26 | 460 | 81 | 100 | 81 | 9 | 900 | 16 | 18 | 34 | Comp. Ex. |
| 11 | F | 835 | 13 | 17 | 440 | 54 | 98 | 55 | 24 | 2352 | 20 | 29 | 46 | Ex. Inv. |
| 12 | F | 825 | 6 | 21 | 450 | 64 | 91 | 70 | 13 | 1183 | 22 | 29 | 33 | Comp. Ex. |
| 13 | G | 850 | 17 | 18 | 430 | 39 | 74 | 53 | 31 | 2294 | 29 | 48 | 36 | Ex. Inv. |
| 14 | H | 845 | 15 | 27 | 445 | 50 | 90 | 56 | 25 | 2250 | 24 | 34 | 43 | Ex. Inv. |
| 15 | I | 840 | 20 | 21 | 460 | 54 | 96 | 56 | 24 | 2304 | 21 | 29 | 45 | Ex. Inv. |
| 16 | J | 850 | 15 | 20 | 470 | 52 | 66 | 79 | 30 | 1980 | 31 | 48 | 27 | Comp. Ex. |
| 17 | K | 830 | 24 | 15 | 415 | 53 | 101 | 52 | 21 | 2121 | 17 | 19 | 49 | Comp. Ex. |
| 18 | L | 825 | 12 | 26 | 485 | 65 | 87 | 75 | 21 | 1827 | 16 | 17 | 37 | Comp. Ex. |
| 19 | M | 840 | 19 | 18 | 455 | 58 | 79 | 73 | 23 | 1817 | 23 | 29 | 36 | Comp. Ex. |
| 20 | N | 835 | 11 | 22 | 410 | 61 | 86 | 71 | 22 | 1892 | 18 | 19 | 35 | Comp. Ex. |
| 21 | O | 845 | 17 | 16 | 420 | 46 | 70 | 66 | 29 | 2020 | 23 | 28 | 34 | Comp. Ex. |

As is apparent from Table 2, each of the steel products in accordance with the present invention had a tensile strength of not smaller than 70 kgf/mm² and had a low yield ratio, a good strength-ductility balance, a good side bending elongation, a good hole expanding ratio, and high fatigue strength.

Figure 5:
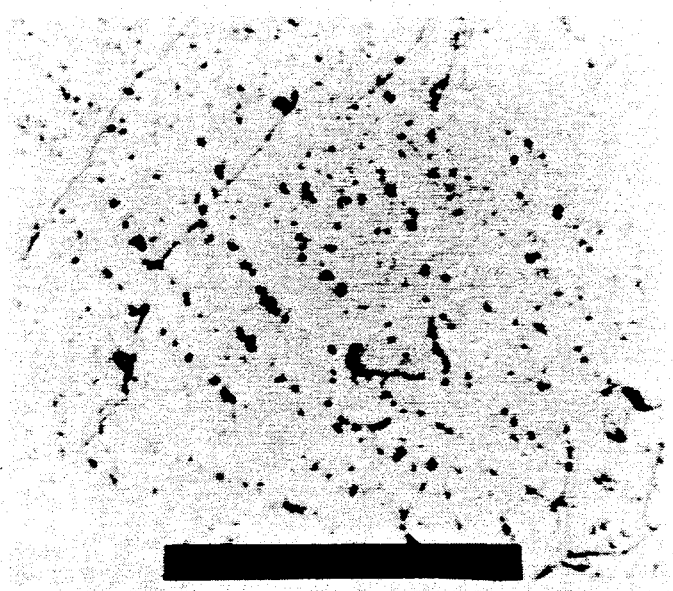
FIG. 5 is a photograph of a microstructure of a ferrite grain of a test No. 1 steel sheet taken at a magnification of 50,000 by a transmission electron microscope.

FIG. 5 shows a photograph of a microstructure of a ferrite grain of a test No. 1 steel-sheet taken by a transmission electron microscope. Fine streaks of a TiC precipitate can be recognized. Thus, the microstructure of the examples of the steel sheet in accordance with the present invention was essentially formed of precipitation-strengthened ferrite and martensite. Specifically, with respect to the test pieces Nos. 3, 11, and 15, retained austenite was also observed. These examples of the present invention were also improved in spot-welding weldability.

On the other hand, test piece No. 16 had a C content out of the critical range (lower limit) in accordance with the present invention and exhibited characteristics closer to those of precipitation-strengthened steel, i.e., a high yield ratio and a small fatigue strength, although the side bending elongation and the hole expanding ratio were suitable. Test piece No. 17 had a C content out of the upper limit which is critical to this invention and exhibited characteristics closer to those of structure-strengthened steel, i.e., a small side bending elongation and a small hole expanding ratio, although the strength-ductility balance and the fatigue strength were good. Also, the deterioration of strength of a spot-welded portion of this test piece was great.

According to the present invention, as described above, a high-strength hot-rolled steel sheet can easily be manufactured which has both the features of the conventional precipitation-strengthened steel and structure-strengthened steel, and which has a tensile strength of 70 kgf/mm$^2$, while the above-described problems of these steels are advantageously overcome. Further, the hot-rolled steel sheet obtained by the method of the present invention has a low yield ratio and exhibits a good strength-ductility balance while having high strength. The steel sheet also has improved stretch flanging formability, typically, side bending elongation and hole expanding ratio, as well as fatigue characteristics and spot-welding weldability. It is very advantageous for use as inner plates, chassis parts and strength members of motor vehicles, for example.

What is claimed is:

1. A low-yield-ratio high-strength hot-rolled steel sheet having a composition essentially consisting of about:

0.18 wt. % or less of C;
more than 0.6 to 2.5 wt. % of Si;
0.5 to 2.5 wt. % of Mn;
0.05 wt. % or less of P;
0.02 wt. % or less of S;
0.01 to 0.1 wt. % of Al;
an element selected from the group consisting of about 0.02 to 0.5 wt. % of Ti and about more than 0.04 to 1.0 wt. % of Nb, and mixtures thereof, said Ti and Nb being present approximately in relation to C according to the following formula:
C wt. %$\geqq$0.05+Ti wt. %/4+Nb wt. %/8; and
the balance substantially Fe and incidental impurities;
wherein the structure of the steel comprises substantially ferrite and martensite containing a precipitated carbide of Ti and/or Nb or said precipitated carbide and residual austenite.

2. A low-yield-ratio high-strength hot-rolled steel sheet having a composition essentially according to claim 1, and further comprising about 0.3 to 1.5 wt. % of Cr.

3. A method of manufacturing a low-yield-ratio high-strength hot-rolled steel sheet, said method comprising the steps of:

preparing a steel slab having a composition according to the following formula:
0.18 wt. % or less of C;
0.5 to 2.5 wt. % of Si;
0.5 to 2.5 wt. % of Mn;
0.05 wt. % or less of P;
0.02 wt. % or less of S;
0.01 to 0.1 wt. % of Al;
an element selected from the group of about 0.02 to 0.5 wt. % of Ti and about 0.03 to 1.0 wt. % of Nb, and mixtures thereof, said Ti and Nb being present approximately in relation to C according to the following formula:

$$C \text{ wt. } \% \geqq 0.05 + Ti \text{ wt. } \%/4 + Nb \text{ wt. } \%/8; \text{ and}$$

the balance substantially Fe and incidental impurities;
hot-rolling the prepared steel slab;
finishing the hot-rolling at a temperature of about 820° C. or higher;
retaining the rolled steel sheet in the range of temperatures of about 820° to 720° C. for at least 10 seconds;
cooling the steel sheet at a cooling rate of about 10° C./sec or higher; and
coiling temperature of about 500° C. or lower.

* * * * *